US005317968A

United States Patent [19]

Saitou et al.

[11] Patent Number: 5,317,968

[45] Date of Patent: Jun. 7, 1994

[54] PLATE COCKING APPARATUS FOR SHEET-FED PRINTING PRESS

[75] Inventors: Shigetoshi Saitou; Osamu Sugiyama, both of Shizuoka, Japan

[73] Assignee: Shinohara Machiner Co., Ltd., Shizuoka, Japan

[21] Appl. No.: 32,712

[22] Filed: Mar. 17, 1993

Related U.S. Application Data

[63] Continuation of Ser. No. 796,311, Nov. 22, 1991, abandoned.

[51] Int. Cl.[5] ..... B41F 27/06; B41F 27/12

[52] U.S. Cl. ..... 101/415.1

[58] Field of Search ..... 101/415.1, 378, 409, 101/410, 411, 412, 375

[56] References Cited

U.S. PATENT DOCUMENTS

| | | | |
|---|---|---|---|
| 3,858,512 | 1/1975 | Simeth | 101/415.1 |
| 3,884,147 | 5/1975 | Abendroth | 101/415.1 |
| 4,712,476 | 12/1987 | Jeschke | 101/378 X |
| 4,831,931 | 5/1989 | Jeschke et al. | 101/378 X |
| 4,864,930 | 9/1989 | Runyan | 101/365 |
| 5,097,763 | 3/1992 | Simeth | 101/415.1 |

FOREIGN PATENT DOCUMENTS

| | | |
|---|---|---|
| 60-72731 | 4/1985 | Japan . |
| 62-56146 | 3/1987 | Japan . |
| 63-53034 | 10/1988 | Japan . |
| 1108046 | 4/1989 | Japan . |
| 3190736 | 8/1991 | Japan . |

*Primary Examiner*—J. Reed Fisher
*Attorney, Agent, or Firm*—Ladas & Parry

[57] ABSTRACT

A plate cocking apparatus for a plate cylinder of a sheet-fed printing press including a clamp on a front grip end of the plate cylinder and a clamp on a rear grip end of the plate cylinder. Both clamps are disposed inside a groove of the plate cylinder and both clamps engage a plate wound on the outer periphery of the plate cylinder. The apparatus further includes drive assemblies for moving the clamp on the front grip end in both the axial and circumferential directions. The drive assemblies are connected to a motor within the plate cylinder.

4 Claims, 7 Drawing Sheets

PLATE COCKING APPARATUS FOR SHEET-FED PRINTING PRESS

This is a continuation of copending application(s) Ser. No. 07/796,311 filed on Nov. 22, 1991, now abandoned.

BACKGROUND OF THE INVENTION:

1. Field of the Invention

This invention relates to a sheet-fed printing press, and more particularly to a plate cocking apparatus for correcting a register error resulting from distortion of a plate position.

2. Description of the Prior Art

In a multi-color printing press, a plate is wound on each of plate cylinders that are disposed in the same number as the number of colors, and printing is sequentially carried out for each color. In this case, high printing quality cannot be obtained unless each color printing is made sequentially at a correct position of a sheet of paper.

To obtain a correct register for each color, crisscross marks referred to as "register marks" are printed in a margin of the sheet of paper. A plate or a plate cylinder is register-adjusted by measuring the deviation of the register marks for each color.

Register errors can be classified into parallel errors where the register marks deviate in parallel in horizontal/vertical direction(s) of the plate, and distortion that occurs when phase error in the horizontal direction is combined with error in the vertical direction.

As a counter-measure for the parallel errors, a technique for correcting the register error by adjusting the plate cylinder itself in its axial/circumferential direction(s) has already been established but this technique is not the subject matter of the present invention.

As the counter-measures for the distortion, mention can be made of the manual adjustment technique which is disclosed in Japanese Patent Publication No. 53034/1988, but this technique wastes time and moreover, must stop the operation of a printing press. A cocking apparatus by socalled "plate cylinder cocking", which is disclosed in Japanese Patent Laid-Open No. 72731/1985, applies an excessive load to the printing press and moreover, its structure is extremely complicated.

Japanese Patent Laid-Open No. 56146/1987 discloses a hydraulic cocking apparatus for effecting so-called "plate cylinder cocking and Japanese Patent Laid-Open No. 108046/1989 discloses a technique which integrally moves a front grip end and a rear grip end of a plate. However, both of them are complicated in structure and are not much practical.

SUMMARY OF THE INVENTION

In view of the problems with the prior art described above, the present invention provides an improved plate cocking apparatus and is primarily directed to make the structure practical, to make control easier and reliable, to make adjustment during the operation of a printing press and to prevent an excessive load from being applied to the press.

To accomplish the objects described above, in a plate cocking apparatus for a sheet-fed printing press of the type wherein a clamper on a front grip end and a clamper on a rear grip end that together form a pair are disposed inside a groove of a plate cylinder and both of them keep a plate wound round the outer periphery of the plate cylinder under a tensile state, the plate cocking apparatus of the present invention is characterized in that means for moving the clamper on the front grip end in the axial direction of the plate cylinder is disposed at the substantial center of the clamper on the front grip end, and means for moving the clamper on the front grip end in the circumferential direction of the plate cylinder are disposed at both right and left end portions of the clamper on the front grip end.

Since the construction described above generates a combined motion in the axial/circumferential direction(s) inside the clamper on the front grip end, a register error resulting from distortion of the plate under a tensile state can be adjusted, and satisfactory printing quality can be obtained.

Other objects and novel features of the present invention will become more apparent from the following description in conjunction with the accompanying drawings, but it is merely illustrative but is in no way limiting the present invention.

DESCRIPTION OF THE PREFERRED EMBODIMENT:

Hereinafter, a preferred embodiment of the present invention will be described in detail with reference to the accompanying drawings.

Figure 1:
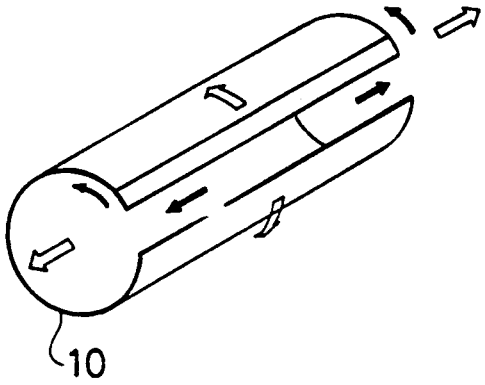
FIG. 1 is a conceptual perspective view useful for explaining the movement of a plate by a plate cocking apparatus for a sheet-fed printing press according to the present invention.

FIG. 1 is a conceptual perspective view which is useful for explaining the movement of a plate in a plate cocking apparatus for a sheet-fed printing press according to the present invention. As to the adjustment in an axial/circumferential direction of a plate cylinder (represented by white arrow in the drawing), a plate (10) itself, which is wound around the outer periphery of the plate cylinder, is moved and regulated in its axial/circumferential direction so as to correct its parallel error, in the same way as in the prior art. The primary object of the present invention is to correct the distortion of the plate (10), that cannot be corrected by such a regulation of the plate cylinder, by generating combined motion in the axial/circumferential direction of the plate cylinder with respect primarily to a front grip end (represented by thick line) of the plate (10).

Figure 2:
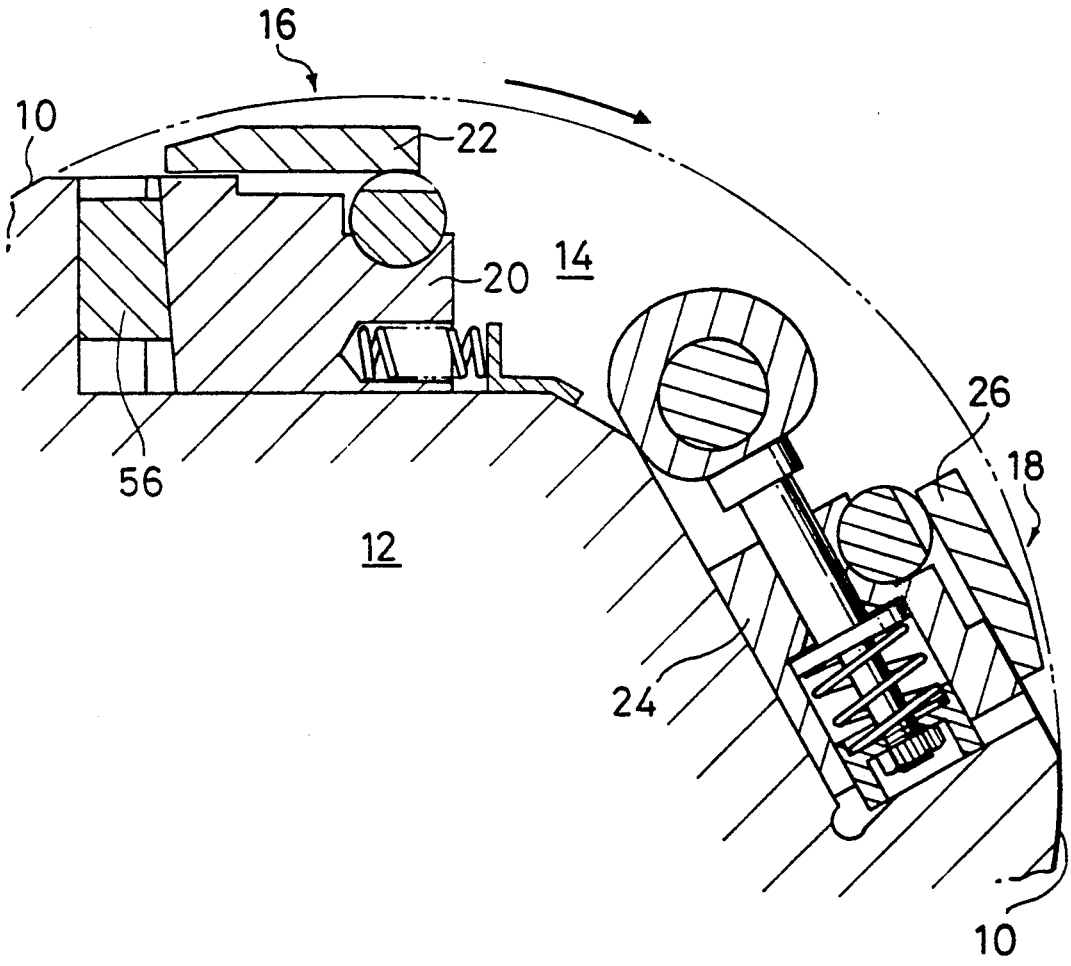
FIG. 2 is a partial sectional view of a plate cylinder equipped with clampers for a plate as the premise of the present invention.

FIG. 2 is a partial sectional view of the plate cylinder equipped with a plate clamping device as the premise of the apparatus of the present invention. As is well known in the art, a groove (14) as a notch portion is formed at part of the outer periphery of a plate cylinder (12) that constitutes the nucleus of a sheet-fed offset press along with a rubber blanket and impression cylinders, that are not shown in the drawing, in the axial direction of the plate cylinder (12) (in the vertical direction in FIG. 2). A clamper (16) on a front grip end for clamping the front part of the plate (10) and a clamper (18) on a rear grip end for clamping the rear part of the plate (10) are so juxtaposed in this groove (14) as to form a pair. The clamper (16) on the front grip end which is extended in the axial direction of the plate cylinder (12) consists of a clamp base (20) capable of moving along the bottom of the groove (14) and a clamp plate (22) disposed on this clamp base (20) and capable of turning up and down as its principal constituents. The plate (10) is clamped at its front part between the clamp plate (22) and the clamp base (20) as shown in the drawing. This arrangement substantially holds true of the clamper (18) on the rear grip end, and a clamp base (24) and a clamp plate (26) clamp the rear part of the plate (10).

Tensile force is provided to the plate (10) by the repulsion of various springs fitted to the clampers (16), (18) on both front and rear grip ends, so that the plate (10) is tightly wound around the outer periphery of the plate cylinder (12). Incidentally, since the plate (10) is made of aluminum as a base material, it does not undergo deformation even when the tensile force described above is applied to it.

Figure 3:
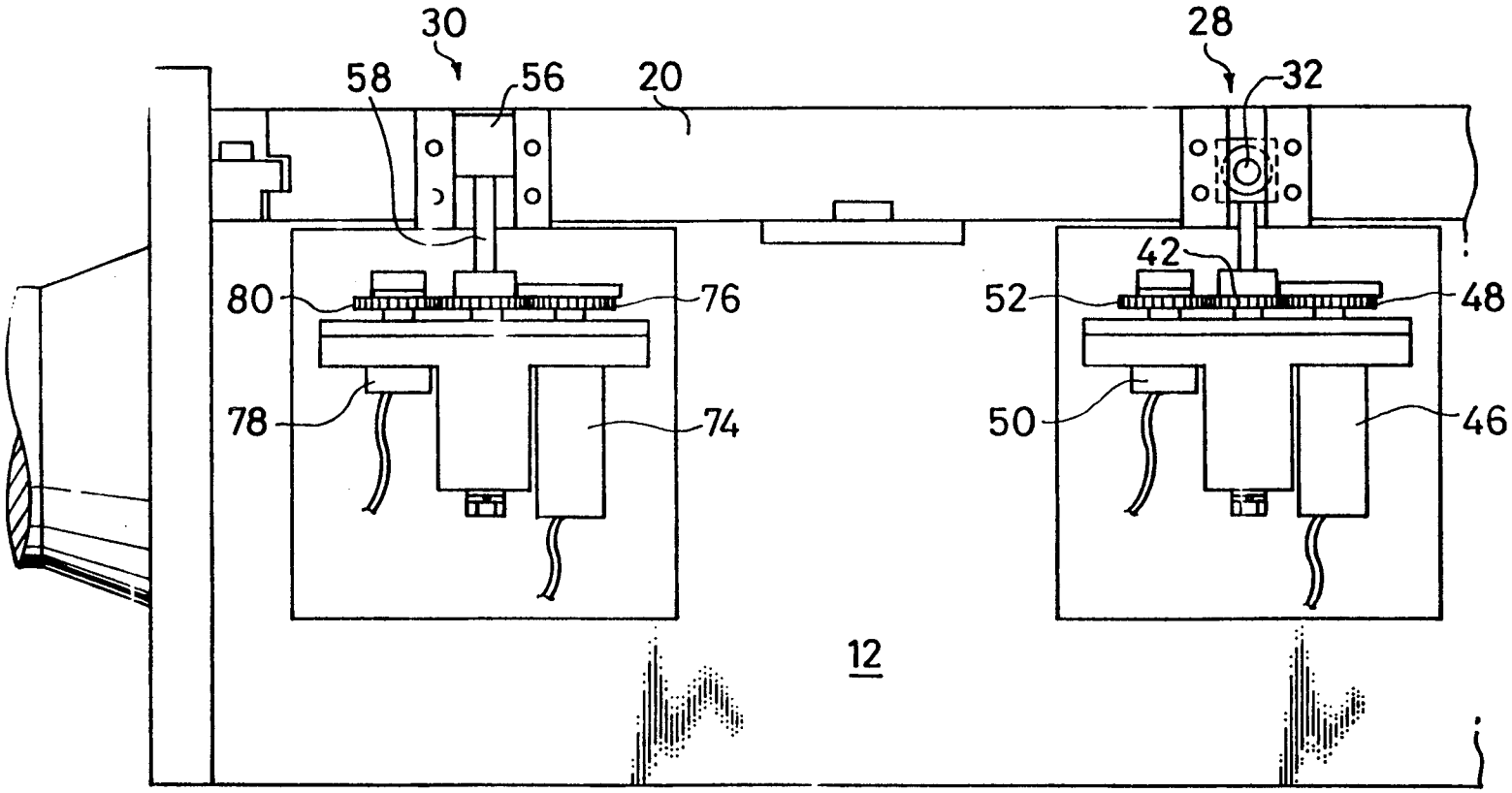
FIG. 3 is a sectional explanatory view of a left half portion of a plate cylinder equipped with a plate cocking apparatus according to the present invention.

FIG. 3 is a sectional explanatory view of the half of the plate cylinder equipped with the plate cocking apparatus of the present invention on the premise described above. Means (represented by reference numeral (28) as a whole) for moving the clamper (16) on the front grip end in the axial direction (in the vertical direction in FIG. 3) of the plate cylinder (12) is disposed substantially at the center of the clamper (16) on the front grip end, and means (represented by reference numeral (30) as a whole) for moving this clamper on the front grip end in the circumferential direction (in the perpendicular direction to the sheet of drawing in FIG. 3) of the plate cylinder (12) are disposed at the both right and left sides of the clamper (16) on the front grip end. As is well known, the clamp base (20) of the clamper (16) on the front grip end can move along the bottom of the groove (14) by using a combination of grooves and protuberances fitting the grooves. It is therefore the primary object of the apparatus of the present invention to generate the combined motion in the axial/circumferential direction of the plate cylinder (12) in the clamper (16) on the front grip end by the two means (28), (30) described above and to correct register error resulting from the strain of the plate (10) under the tensile state.

Figure 4:
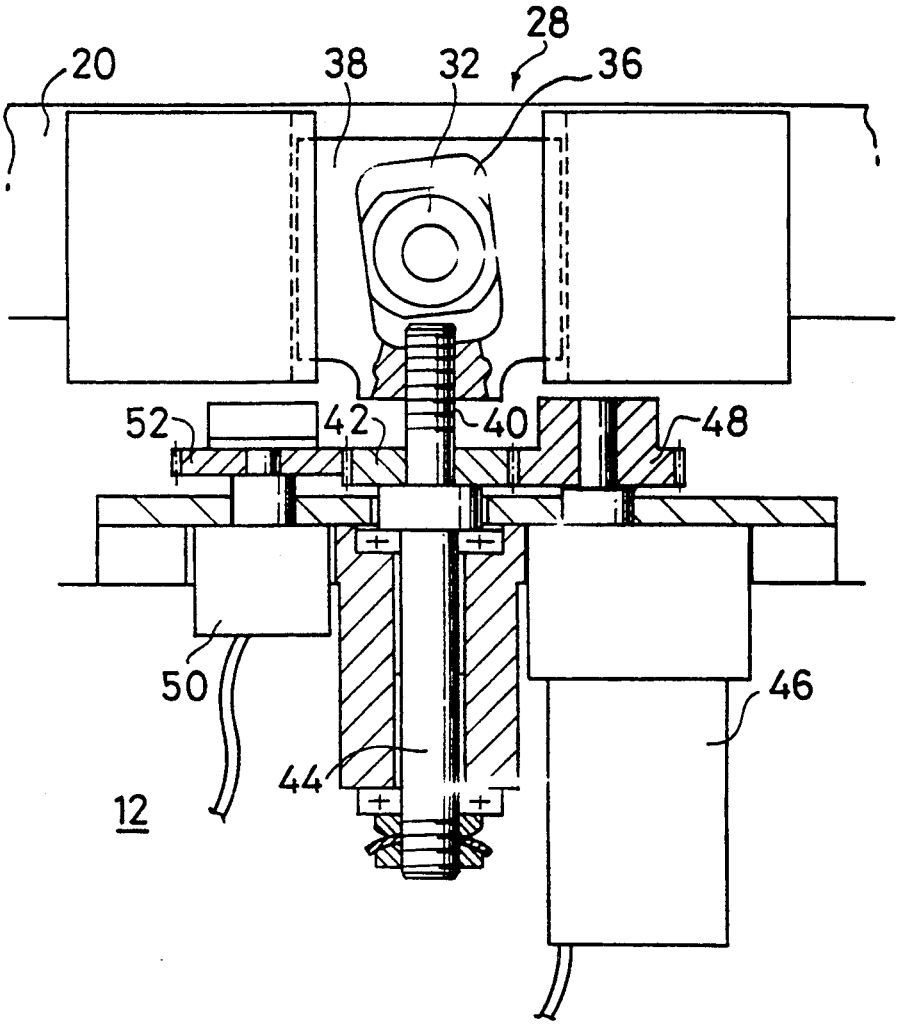
FIG. 4 is an enlarged sectional view of means for moving a clamper on a front grip end in an axial direction of a plate cylinder.
Figure 5:
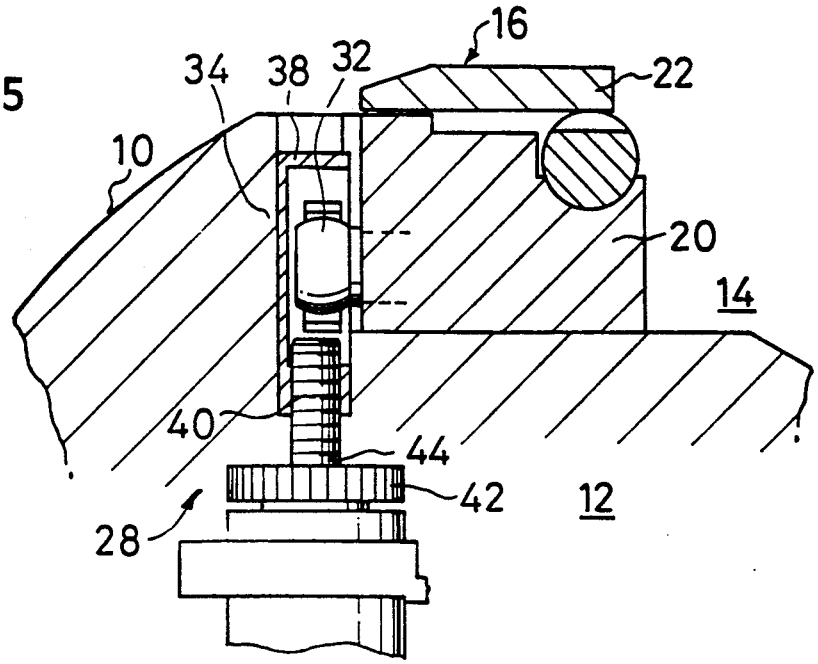
FIG. 5 is similarly an enlarged sectional side view.

FIG. 4 is an enlarged sectional view of the means (28) for moving the clamper (16) on the front grip end in the axial direction of the plate cylinder (12) and FIG. 5 is similarly an enlarged sectional side view. A spherical bearing (32) is fixed substantially at the center of the clamp base (20) on the front grip end in such a manner as to protrude towards the wall (34) of the groove (14). A member (38) which has an inclined groove (36) engaging twistably with the spherical bearing (32) and is so guided as to be capable of moving only in the vertical direction (up/down direction of FIG. 4) to the clamp base (20) is disposed between the clamp base (20) and the wall (34).

On the side of the plate cylinder (12), on the other hand, there is rotatably disposed a rotary shaft member (44) having a screw (40) meshing with the member (38) and a gear (42). The gear (42) of this rotary shaft member (44) meshes with a gear (48) of a motor (46) as an electric driving source of the rotary shaft member (44) and with a gear (52) of a potentiometer (50) for measuring the rotating distance.

As can be seen clearly from FIG. 4, when the member (38) having the inclined groove (36) is moved in the vertical direction by the rotation of the rotary shaft member (44) meshing with the member (38), the clamp base (20) having the spherical bearing (32) meshing with the inclined groove (36) is moved in the horizontal direction of FIG. 4, that is, in the axial direction of the plate cylinder. It is the motor (46) that applies the turning torque to the rotary shaft member (44), and the gist of the present invention resides in that the electric driving source for moving the clamper (16) on the front grip end is incorporated in the plate cylinder (12). Accordingly, only power need be supplied from outside the plate cylinder (12), and mechanical linking that is described in Japanese Patent Laid-Open No. 190736/1991 is not necessary in the invention.

Figure 6:
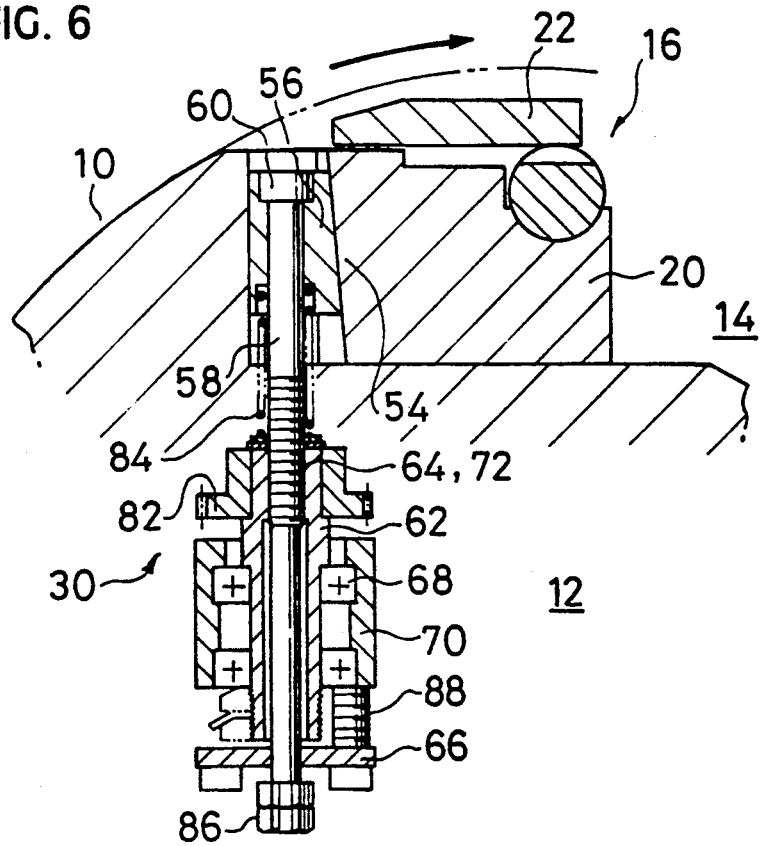
FIG. 6 is an enlarged sectional side view of means for moving the clamper on the front grip end shown in FIG. 3 in the circumferential direction of the plate cylinder.

FIG. 6 is an enlarged sectional side view of means (30) for moving the clamper (16) on the front grip end shown in FIG. 3 in the circumferential direction of the plate cylinder (12), and such means (30) are disposed independently at both right and left end portions of the clamper (16) on the front grip end. As described already, the clamp base (20) is allowed to move in the axial direction (in the perpendicular direction to the sheet of drawing of FIG. 6) and in the circumferential direction (in the horizontal direction of FIG. 6) of the plate cylinder (12) along the bottom of the groove (14), while it receives the force of the spring, not shown, and the force of the plate (10). Moreover, an inclined side portion (54) is formed.

An inclined member (56) having an inclined surface which is inclined in the opposite direction to the inclined side portion (54) and guided movably in the vertical direction (in the up/down direction of FIG. 6) to the clamp base (20) is interposed between the wall (34) of the groove (14) and the inclined side portion (54) of the clamp base (20). It can be understood that when this inclined member (56) is moved in the vertical direction, the end portion of the clamp base (20) can be moved in the circumferential direction of the plate cylinder (12).

To move the inclined member (56) in the vertical direction, the shaft member (58) is first fitted idly to the inclined member (56). The head (60) of the shaft member (58) prevents the shaft member (58) from falling off from the inclined member (56). The shaft member (56) is equipped with a screw portion (64) meshing with a rotary member (62) substantially at its intermediate portion, its rotation is prevented by the base plate (66) on the plate cylinder (12) side, and the like, and only its movement in the vertical direction is permitted.

The rotary member (62) is turnably supported by a holder (70) through a bearing (68), has a screw portion (72) meshing with the shaft member (58) inside it and has also a gear portion (82) meshing with the gear (76) of the motor (74) shown in FIG. 3 and with the gear (80) of the potentiometer (78). As to these motor (74) and potentiometer (78), the circumstances are exactly the same as in the case of the means (28) for moving the clamper (16) on the front grip end in the axial direction of the plate cylinder (12).

An expanding spring (84) is interposed between the upper part of the rotary member (62) and the bottom of the inclined member (56) with the shaft member (58) as its center and always pushes the inclined member (56) in the vertical direction.

When the rotary member (62) is rotated by the motor (74) and the shaft member (58) meshing with this rotary member (62) is moved upward in the vertical direction of FIG. 6, the inclined member (56) is pulled down against the force of the expanding spring (84). Accordingly, one of the ends of the clamp base (20) is moved to the left in FIG. 6 and the plate (10), too, is moved with this movement. To return one of the ends of the clamp base (20) to the right in FIG. 6, on the contrary, the motor (74) is rotated reversely and only the shaft member (58) is first returned to its original position at the up position in the vertical direction while the pull force of the plate (10) is released (e.g. at the time of removal of the plate (10)). Then, the inclined member (56) rises and returns to the original position until it is restricted by the head (60) of the shaft member (58). At this time, the clamp base (20), too, moves to the right and can return to the original position. At this time, the origin returning function by the shaft member (58), the inclined member (56) and the expanding spring (84) prevents any excessive force from acting on the plate (10) and improves maneuverability. Reference numeral (86) denotes a stop nut of the shaft member (56) and reference numeral (88) denotes a bolt for fixing the holder (70) to the base plate (66).

Figure 7:
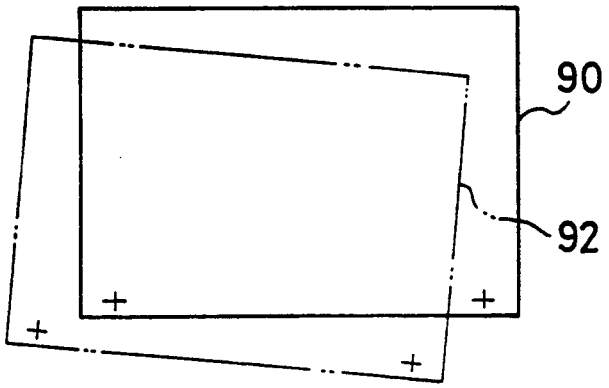
FIGS. 7 to 11 are printing image diagrams useful for explaining the operation of the apparatus of the present invention.

Next, the function will be explained with reference to printing image diagrams of FIGS. 7 to 11. To simplify the explanation, the description will be given about the case where the printing image (represented by (90)) in a first printing unit and the printing image (represented by (92)) in a second printing unit in multi-color printing are deviated from each other as shown in FIG. 7, by way of example, but it could be understood by those skilled in the art that the invention can be similarly applied to other cases, as well. In this case, the side provided with register marks corresponds to the front grip end of the plate (10).

Figure 8:
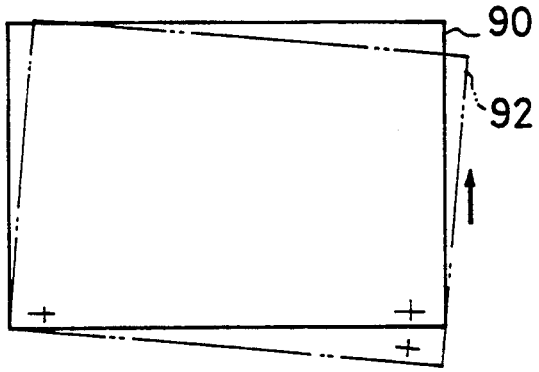

First of all, the plate cylinder (12) is adjusted in both axial and circumferential directions and the printing images at this time are adjusted so that their register marks on one of the sides coincide with each other as shown in FIG. 8. Next, in order to bring the register marks on the other side into conformity with each other, the means (30) for moving one of the ends of the clamper (16) on the front grip end of the apparatus of the present invention corresponding to the right side of FIG. 8 in the circumferential direction of the plate cylinder (12) is actuated. More definitely, this means (30) is the one that is shown in FIG. 6 and its operation has already been described.

Figure 9:
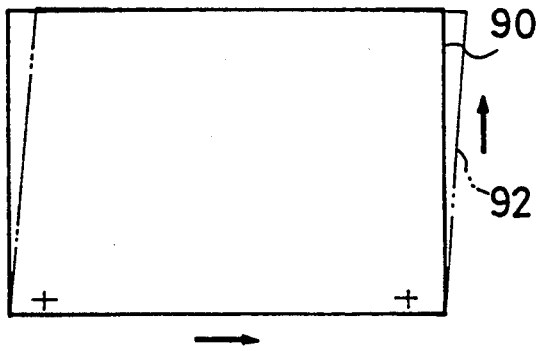
Figure 10:
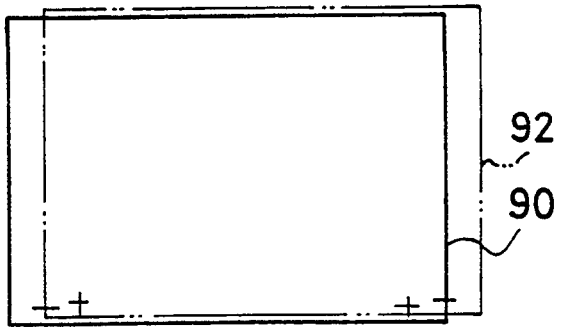
Figure 11:
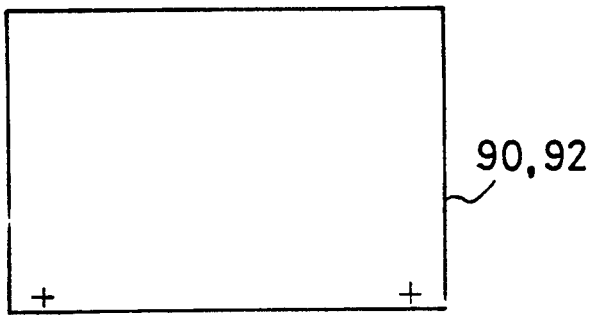

As a result, the register marks on the front grip end of the plate (10) coincide with one another on both right and left sides as shown in FIG. 9, but the printing image (92) by the plate (10) of the second printing unit is distorted in a parallelogramic shape. Accordingly, the plate (10) is cocked by operating both of the means (28) for moving the clamper (16) on the front grip end of the present apparatus in the axial direction of the plate cylinder (12) and the means (30) for moving it in the circumferential direction (only one of the sides may be used). Then, the state is reached where only the parallel error is left, as shown in FIG. 10. Therefore, the plate cylinder (12) is again adjusted in the axial/peripheral directions and finally, both printing images (90) and (92) completely coincide with each other as shown in FIG. 11. In this way, cocking of the plate (10) is completed.

The plate cocking apparatus of the present invention has a simple construction and is easy to operate and yet provides the significant advantage that the register error can be corrected completely by generating the combined motion in the clamper on the front grip end. Since the electric driving source is incorporated in the cylinder plate, troublesome linking with the outside is not necessary, and cocking can be freely carried out during the operation of the printing press. Moreover, the movement of the position of the plate based on the combined motion generated on the front grip end of the plate can be rapidly expanded throughout the plate as a whole by the push force of the rubber blanket cylinder which comes into contact with the plate cylinder.

The present invention is not particularly limited to the embodiment given above and various changes and modifications could be made by those skilled in the art without departing from the spirit thereof.

We claim:

1. A plate cocking apparatus for a plate cylinder of a sheet-fed press, the plate cocking comprising:

a first clamping means on a front grip end of a plate cylinder on an inside portion of a groove of said plate cylinder for engaging a plate wound on an outer periphery of said plate cylinder in a tensile state;

first driving means for moving said first clamping means in an axial direction of said plate cylinder, said first driving means being disposed substantially at an axially central portion of said first clamping means so as to exert a driving force on the central portion of said first clamping means;

second driving means for moving said first clamping means in a circumferential direction of said plate cylinder, said second driving means being disposed at both of opposite axial end portions of said first clamping means; and motorized drive means within the plate cylinder for driving said first and second drive means and causing movement of said first clamping means.

2. The plate cocking apparatus according to claim 1, further comprising a potentiometer means connected to said first and second drive means for measuring movement of said first clamping means.

3. A plate cocking apparatus for a plate cylinder of a sheet-fed printing press, the plate cocking apparatus comprising:

clamping means on an inside portion of a groove of a plate cylinder for engaging a plate wound on an outer periphery of said plate cylinder in a tensile state;

first driving means for moving said clamping means in an axial direction of said plate cylinder, said first driving means being disposed at an axially substantially central portion of said clamping means;

second driving means for moving said clamping means in a circumferential direction of said plate cylinder, said second driving means being disposed at opposite axial end portions of said clamping means; and motorized drive means within the plate cylinder for driving said first and second drive means and causing movement of said clamping means.

4. The plate cocking apparatus according to claim 3, further comprising a potentiometer means, connectable to said first and second drive means, for measuring movement of said clamping means.

* * * * *